United States Patent [19]

Schmidt et al.

[11] Patent Number: 4,727,891

[45] Date of Patent: Mar. 1, 1988

[54] IGNITION SYSTEM

[75] Inventors: Albert Schmidt, Bietigheim; Roland Gaisser, Ludwigsburg; Dieter Teutsch, Sachsenheim; Hans Albrecht, Waiblingen; Rudolf Maly, Sindelfingen; Eberhard Wagner, Stuttgart, all of Fed. Rep. of Germany

[73] Assignee: BERU Ruprecht GmbH & Co. KG, Ludwigsburg, Fed. Rep. of Germany

[21] Appl. No.: 852,285

[22] Filed: Apr. 15, 1986

[30] Foreign Application Priority Data

Apr. 15, 1985 [DE] Fed. Rep. of Germany ..... 3513422

[51] Int. Cl.[4] ..... F02P 1/00

[52] U.S. Cl. ..... 123/627; 123/620

[58] Field of Search ..... 123/620, 622, 627

[56] References Cited

U.S. PATENT DOCUMENTS

| | | | |
|---|---|---|---|
| 2,950,419 | 8/1960 | Linkroum | 123/627 |
| 3,575,153 | 4/1971 | Hardin | 123/627 |
| 4,510,915 | 4/1985 | Ishikawa | 123/620 |
| 4,562,823 | 1/1986 | Moritugu | 123/620 |

*Primary Examiner*—Ronald B. Cox

*Attorney, Agent, or Firm*—Sixbey, Friedman & Leedom

[57] ABSTRACT

An ignition system having a low voltage source serving as a starting point for producing of an ignition voltage at least one ignition spark gap via at least one ignition branch, said branch including a said ignition spark gap, a high voltage capacitor, a high voltage transformer for producing a voltage at the high voltage capacitor of at least the same order of magnitude as said ignition voltage, an auxiliary spark gap having a breakdown threshold, and timing control means for controlling voltage delivery timing to said branch; wherein said auxiliary spark gap is disposed at an output side of said high voltage transformer and said high voltage capacitor is coupled to said auxiliary spark gap in a manner causing the high voltage capacitor to discharge to said ignition spark gap when the breakdown threshold of the auxiliary spark gap is exceeded; wherein the high voltage transformer has minimum inductances and minimum impedances; wherein a medium voltage transformer for producing a voltage between the low voltage and the ignition voltage and a medium voltage storage capacitor that is chargeable by said medium voltage transformer are provided between the low voltage source and the high voltage transformer; and wherein a controllable element is provided in said branch at an input side of said high voltage transformer, said controllable element being controlled by the timing control means in a manner operable for separating and interconnecting said high voltage transformer and said medium voltage storage capacitor.

7 Claims, 3 Drawing Figures

IGNITION SYSTEM

BACKGROUND OF THE INVENTION

The present invention relates to an ignition system of the type having parallel ignition branches with an ignition spark gap, an auxiliary spark gap and a high voltage storage capacitor that is dischargeable via the ignition spark gap.

When designing an ignition system, it is a basic objective to produce sparks with a maximum ignitability. High ignitability is of particular significance in connection with the lean-burn engines at present being developed for fuel saving purposes, which use less readily igniting, sluggishly reacting fuel-air mixtures (lambda≧1.4) and with the use of exhaust catalysts, which only accept misfirings to a limited extent, because unburned fuel entering the catalyst can lead to a combustion of the catalyst.

The use of high voltage storage capacitors and an auxiliary spark gap in conjunction with the actual spark plug spark gap (DE-OS No. 28 10 159) has made it possible to obtain energy-rich ignition sparks, which also advantageously convert most of their energy in the so-called spark head, i.e. in the break-through phase. However, in the case of such an arrangement, a high capacitance capacitor in the form of the storage capacitor must be charged to essentialy the ignition voltage, which is not possible with conventional transistor ignition systems due to their poor efficiency or even in the case of high voltage capacitor ignition systems with per se good efficiency, but low power with acceptable loading of the primary energy source (battery, electrical generator). This is mainly due to losses in the ignition coil and in the high voltage ignition distributor through which the secondary side of said coil is connected to the particular ignition branch.

SUMMARY OF THE INVENTION

The problem of the present invention is to provide an ignition system which, without boosting or additional loading of the primary energy source, is able to reliably supply the required ignition voltage and at the same time energy-rich ignition sparks.

According to the invention this problem is solved.

The use of a low inductance high voltage transformer in the multiplicity of the ignition branches and the resulting obviation of a high voltage-side ignition distributor greatly contributes to recharging the energy in a low-loss manner and extremely rapidly from the medium voltage storage capacitor, on which the primary energy source functions via the medium voltage transformer, to the high voltage storage capacitor. Without loss of charging reliability, the capacitance of the high voltage storage capacitor can be made so high that even following the breaking down of the auxiliary spark gap, i.e. when the storage capacitance and spark plug capacitance are parallel, the voltage at the spark plug gap is still sufficiently high to be sufficient for all operating states on said spark plug spark gap. For a spark plug self-capacitance of approximately 20 pF, values of approximately 300 pF are typical for the high voltage storage capacitor.

The auxiliary spark gap constitutes a switch which, on reaching the breakdown voltage, passes suddenly into the low-inpedance field, the low inductance and low impedance of the complete ignition branch, including that of the voltage transformer producing the high voltage ensuring that voltage rises at the ignition spark gap of approximatey 100 kV/μs can be obtained. Thus, most of the energy converted in the spark plug spark gap is used in the plasma build-up and consequently in the mixture to be ignited.

The low impedance and low inductance required for the individual ignition branches include the switching elements switching the medium voltage storage capacitor to the individual ignition branches. Preferably thyristors are used, which can easily be controlled in a time-correct manner and automatically are rapidly blocked again. A blocking oscillator is preferably provided for the medium voltage transformer on which operates the primary low d.c. voltage source. It is short-circuit-proof, constructable in a relatively loss-free manner, can be adapted in an optimum manner as regards power and has an adequately fast voltage rise. The medium voltage storage capacitor, on which the voltage transformer operates, is preferably charged to a voltage of approximately 700 V and has a capacitance of approximately 1.5 μF. Thus, for a capacitance of approximately 300 pF, the high voltage-side storage capacitor can be charged to voltage values of approximately 30 kV. Such a loss-free transmission proved to be impossible with conventional high inductance ignition coils and with an ignition distribution on the high voltage side.

BRIEF DESCRIPTION OF THE DRAWINGS

The invention is described in greater detail hereinafter relative to non-limitative embodiments and the attached drawings, which show.

DETAILED DESCRIPTION OF THE PREFERRED EMBODIMENTS

Figure 1:
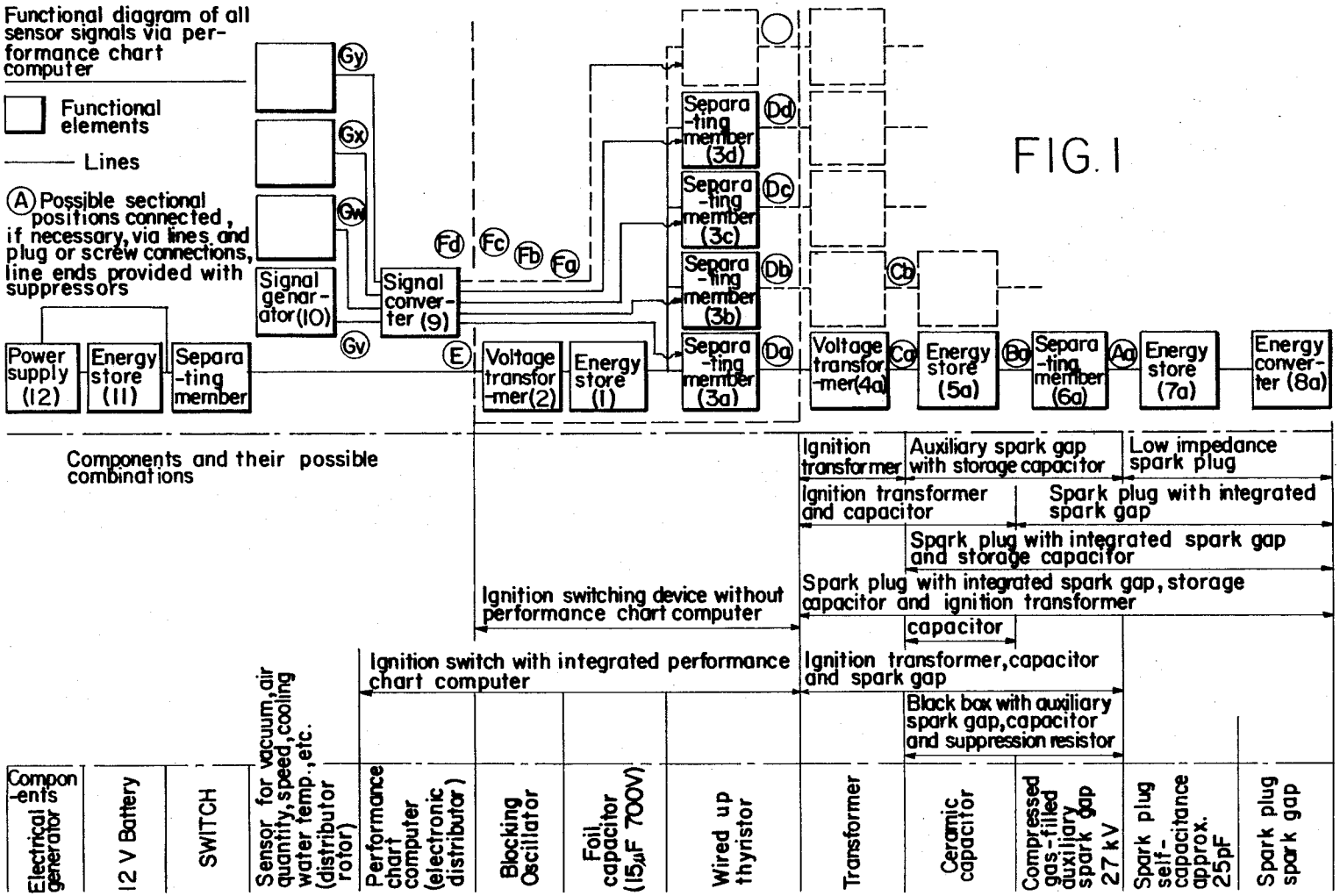
FIG. 1.: a block circuit diagram of an ignition system of a multicylinder internal combustion engine.

On the basis of a power supply or source in the form of an electrical generator 12 and/or a battery (energy store) 11, according to FIG. 1 using a separating member in the form of a switch, a voltage of e.g. 12 V or less, as is typical of such power sources, is applied to a voltage transformer 2 in the form of a blocking oscillator. Blocking oscillator 2 charges a medium voltage energy store 1 in the form of a foil capacitor with a capacitance of e.g. 1.5 μF to a voltage of approximately 700 V. Downstream of said medium voltage energy store 1, there is a parallel branching of the circuit to produce identically constructed branches corresponding to the multiplicity of the units to be ignited, i.e. spark plugs or cylinders. At the output of the medium voltage energy store 1 are provided controllable separating members, preferably high-speed thyristors **3*a*, 3*b*, 3*c*, 3*d*, etc., in a parallel manner and in the same number as the number of ignition branches provided. Such an ignition branch comprises a high voltage transformer 4*x* (x=a, b, c, . . . ) in the form of a very low inductance and ohmically, dielectrically and magnetically particularly low loss transformer with a high coupling factor, a high voltage energy store 5*x* in the form of a ceramic capacitor with a capacitance of approximately 200 to 400 pF, a separating member 6*x* in the form of a compressed gas-filled spark gap and an energy store 7*x*** with energy converter 8x in the form of the spark plug self-capacitance or the spark plug spark gap.

Figure 3:
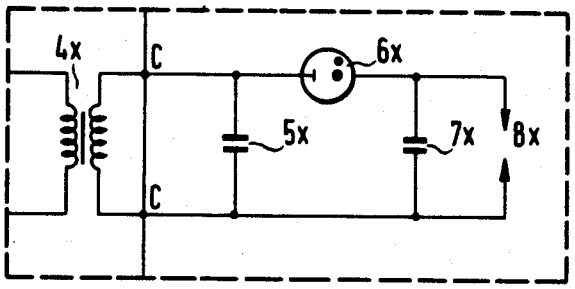
FIG. 3.: the circuit diagram of the secondary side of the high voltage transformer.

A preferred construction of the ignition branch 4x to 8x is shown if FIG. 3. The high voltage storage capacitor 5x is connected to the high voltage output of transformer 4x. Parallel thereto is provided the series connection of the auxiliary spark gap 6x and spark plug capacitance 7x with the ignition spark gap 8x. The spark plug capacitance is typicaly approximately 20 pF. To ensure that before the breakdown of the auxiliary spark gap 6x, the voltage produced by transformer 4x does essentially drop at the auxiliary spark gap 6x, the capacitance of the latter must be small compared with the spark plub capacitance 7x and is preferably approximately 2 pF. The capacitance of storage capacitor 5x must be so high that, after switching through the auxiliary spark gap, i.e. when the capacitance of the storage capacitor 5x and the spark plug capacitance 7x are parallel, the total capacitance must be essentially determined by the capacitance of storage capacitor 5x. This leads to capacitance values for the storage capacitor of the order of magnitude of 100 pF, i.e. 200 to 400 pF. This ensures that the voltage at the spark plug spark gap 8x following the switching through of the auxiliary spark gap 6x does not drop significantly below the voltage to which storage capacitor 5x has been charged. The sought voltage value is approximately 30 kV.

Producing a voltage of approximately 30 kV on a capacitance of approximately a few hundred pF without any additional loading of the primary energy source, i.e. battery or electrical generator, is brought about through the use of low loss, low inductance high voltage transformers 4x in conjunction with no ignition distribution on the high voltage side and the replacement thereof by separating members 3x on the low voltage side of transformers 4x in the multiplicity of said transformers.

Particularly appropriate values for the high voltage transformer are approximately 150 μH inductance, 350 mΩ resistance on the primary side in conjunction with 350 mH inductance and 180Ω resistance on the secondary side. A ferrite core material is responsible for low core losses.

The low inductance of the high voltage transformer 4x leads to extremely rapid recharging processes from the medium voltage storer capacitor into the just locked-on high voltage storage capacitor 5x, which in conjunction with the thus aided rapid breakdown of the auxiliary spark gap 6x supplies voltage rises of approximately 100 kV/μs to the spark plug spark gap. This helps the energy conversion in the ignition spark gap 8x to take place in the head of the ignition spark, i.e. in the nanosecond range and assists in ensuring that in the time available only a negligibly small amount of energy can flow ou via any shunts, such as could e.g. occur through sooting of the spark plug insulator.

Due to the low inductance of the high voltage transformer 4x, its combination with the high voltage storage capacitor 5x or the medium voltage storage capacitor 1 leads to very rapidly oscillating oscillator circuits, so that the energy not converted in the nanosecond range can be returned to the medium voltage storage capacitor. To make this possible, a diode can be provided in antiparallel to the switching path of the thyristor 3x already blocking at this time.

The requirements on the separating member 3x between the medium voltage storage capacitor 1 and the high voltage transformer 4x are in particular that it is controllable in a time-defined manner, switches very rapidly and is of very low impedance in the through-connected state, so as to once again avoid losses here. These requirements are fulfilled by a fast thyristor of the type presently available.

The control of the separating members 3x can take place in a random appropriate manner. The signal converter 9 controlling the separating members 3x can e.g. be a performance chart computer, which controls by means of signal generators 10 (sensors), so that the ignition time can be adjusting corresponding to the engine requirements, loads states, etc. The signal converter 9 can also be a converted mechanical high voltage ignition distributor without high voltage function, which incorporates the sensors for vacuum advance and retard, centrifugal timing control, cylinder detection, etc.

The medium voltage transformer 2 is preferably a blocking oscilltor, because it can be constructed in relatively low loss manner, can have optimum power adaptation, is short-circuit-proof and offers an adequately fast voltage rise in the millisecond range. In addition, it can have a very small construction. It is also possible through the use of the blocking oscillator principle to fully charge the medium voltage energy store 1 with a pulse sequence of approximately 10 Hz adequate for starting the engine, as from a primary voltage of 3 V (extreme cold start).

In a further development of the described principle, it can be provided that in each case several medium voltage energy stores 1 act on each ignition branch, whilst providing corresponding additional separating members 3x. Thus, several energy-rich sparks can be succssively produced per ignition process and spark plug. As the ignition system takes energy from the battery or electrical generator in proportion to the spark sequence, up to half the maximum spark sequence double sparks are possible and at a third of the maximum ignition sequence triple sparks are possible without any greater loading of the battery or electrical generator than at maximum spark sequence.

Time-succeeding multiple sparks can also be obtained in such a way that the available energy of the medium voltage energy store 1 is converted into relation oscillations, in each case with the energy content of the high voltage energy store 5x.

In order to ensure the low impedance nature of the ignition system, it is appropriate to construct the system in a compact manner and with short line paths. FIG. 1 shows several possible sectional positions in the overall chain with the resulting possible combination of partial components in specific constructional units.

Figure 2:
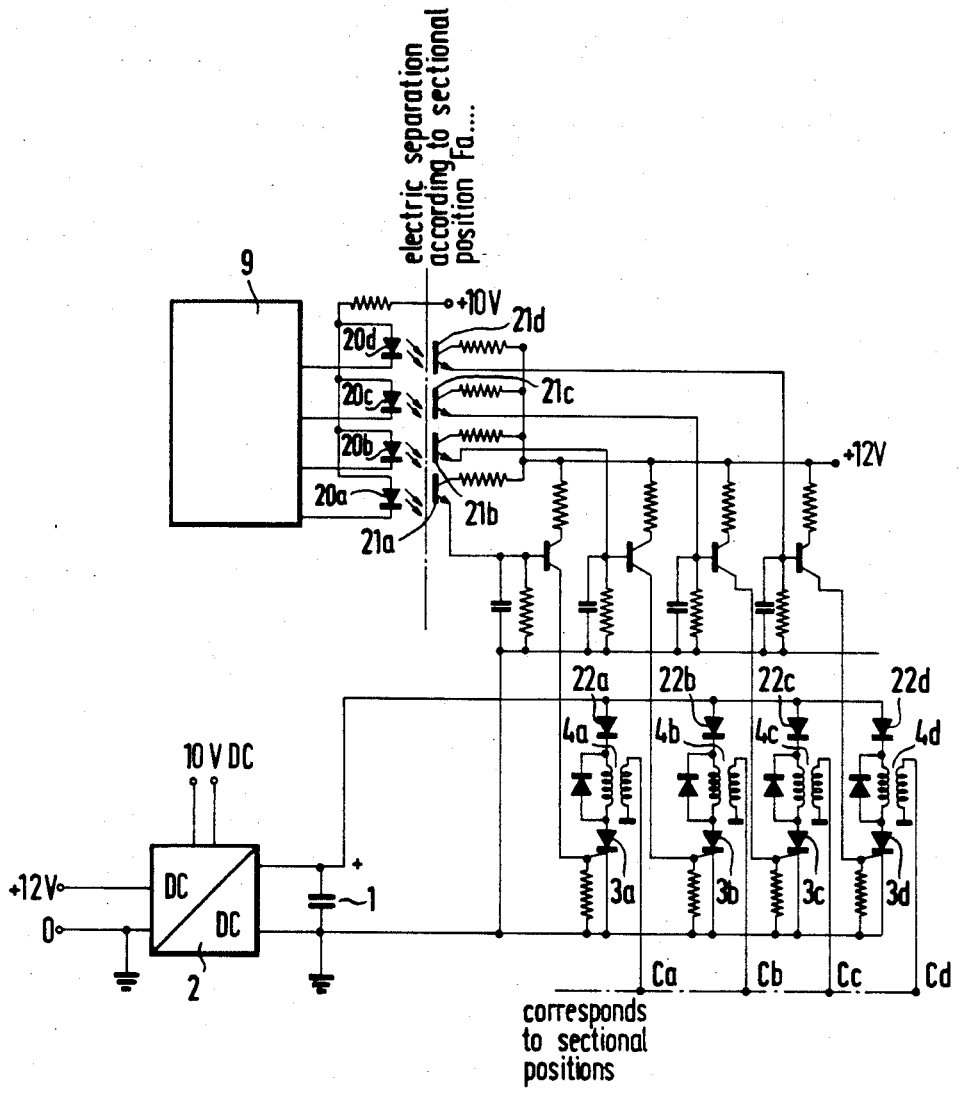
FIG. 2.: the circuit diagram of important parts of FIG. 1 in detail.

FIG. 2 shows part of the circuit of FIG. 1 with further details. The signal converter 9, e.g. a performance chart calculator supplies its output control signals to the light-emitting diodes 20a, 20b, 20c, 20d etc. of optical couplers, by which, for suppressing crosstalk form one ignition branch to the other, the power part is electrically separated from the control elements. Phototransistors 21a, 21b, 21c, 21d etc. of the optical couplers supply their signals to the control electrodes of thyristors 3a, 3b, 3c, 3d etc, which are in series with the primary windings of the high voltage transformers 4a, 4b, 4c, 4d etc. To the series connection of the primary winding of the high voltage transformer 4x and the tyristor 3x, which also includes a decoupling electrode 22x, is applied the voltage of the medium voltage capacitor 1 charged by means of the blocking oscillator 2 from the electrical generator or battery to a voltage of a few hundred volts. As soon as the thyristor, controlled by signal converter 9, switches through, due to the low inductance and low impedance of the high voltage transformer 4x and the speed of thyristor 3x, current flows with a short rise time and high peak current intensities. The high voltage transformer brings about a high transformation of the primary-side voltage and the high voltage storage capacitor 5x (not shown in FIG. 2) is charged with high efficiency in the nanosecond range to the desired voltage of approximately 30 kV.

If a return supply of the energy not converted in the nanosecond range to the medium voltage storage capacitor is desired, then the decoupling diodes 22x are omitted and diodes being antiparallel to the thyristors are provided.

To prove the effectiveness of the present ignition system the following test was performed. A six-cylinder engine was operated with a conventional transistor ignition system with mechanical high voltage distributor, supplemented by auxiliary spark connectors having 100 pF and auxiliary spark gaps of 20 kV. The following deficiencies where revealed:

(a) the mixture in the engine can only be made leaner to a limited extent and the energy of 20 mJ supplied to the gas is not adequate for all operating states. The primary-side power consumption was 96 W.

(b) as up to 23 kV appear on the spark plug in the case of a cold start, although blocking was provided by the auxiliary spark gap up to 20 kV, above this the voltage the spark plug rose with a normal speed of approximately 400 V/μs. In the case of a conductive deposit layer, often too much energy flows out via the insulator base of the spark plug so that misfiring occurs.

(c) at least in the case of a cold, with an internally dewy mechanical distributor there are high voltage sparkovers at a voltage as low as 17 kV and consequently misfiring occurs.

The response voltage of the spark gaps was then increased to 27 kV and the capacitances of the storage capacitors to 330 pF.

This combination could not be made to switch through with any commercially available known ignition system. Retention of the constructional principle would have lead to a power consumption of 360 W at the battery or electrical generator, which would not have been possible without boosting the battery or generator. The ignition coil as the intermediate energy store was then replaced by a capacitor having a capacitance of 1.5 μF to be charged to 700 V through a blocking oscillator and this capacitor was recharged through thyristors and low loss, low inductance transformers present on the low voltage side in the number of the spark plugs into the 330 pF high voltage storage capacitors.

It was then possible to switch through the combination of 330 pF storage capacitor and 27 kV auxiliary spark gap and to offer for each engine operating point the at least 23 kV as a needle pulse with a rise time of 100 kV/μs.

The use of the aforementioned ignition system is not limited to one and multicylinder reciprocating piston-type engines, but can also be extended to rotary piston engines, gas turbines, etc. with the most varied fuels, such as diesel, petrol, alcohol, ethanol, hydrogen, hydrogen-petrol, biogas, natural gas, propane, etc, more or less lean, with more or less good mixture preparation.

The favourable energy utilization in the described ignition system makes it possible, at a reduced ignition energy, to also use it for additional heating systems for motor vehicles. Due to the high efficiency of the ignition system, the primary energy sources can also be solar cells or manually operated dynamos, whilst for short-term operation powerful batteries able to supply a surge current of e.g. 2 A can be used.

What is claimed is:

1. An ignition system having a low voltage source serving as a starting point for producing of an ignition voltage at at least one ignition spark gap via at least one ignition branch, said branch including a said ignition spark gap, a high voltage capacitor, a high voltage transformer for producing a voltage at the high voltage capacitor of at least the same order of magnitude as said ignition voltage, an auxiliary spark gap having a breakdown threshold, and timing control means for controlling voltage delivery timing to said branch; wherein said auxiliary spark gap is disposed at an output side of said high voltage transformer and said high voltage capacitor is coupled to said auxiliary spark gap in a manner causing the high voltage capacitor to discharge to said ignition spark gap when the breakdown threshold of the auxiliary spark gap is exceeded; wherein the high voltage transformer has minimum inductances and minimum impedances; wherein a medium voltage transformer for producing a voltage between the low voltage and the ignition voltage and a medium voltage storage capacitor that is chargeable by said medium voltage transformer are provided between the low voltage source and the high voltage transformer; and wherein a controllable element is provided in said branch at an input side of said high voltage transformer, said controllable element being controlled by the timing control means in a manner operable for separating and interconnecting said high voltage transformer and said medium voltage storage capacitor.

2. An ignition system according to claim 1, wherein a blocking oscillator is used as the medium voltage transformer.

3. An ignition system according to claims 2 or 1, wherein thyristors are used as the controllable switching element.

4. An ignition system according to claim 3, wherein a diode is provided in antiparallel to each thyristor for returning energy to the medium voltage storage capacitor that is not converted into ignition energy at the ignition spark gap during a nanosecond range of operation.

5. An ignition system according to claim 3, wherein the timing control means is electrically separated from the controllable switching element by using optical couplers for signal transmission purposes.

6. An ignition system according to one of claims 2 or 4 or 5 or 1 wherein a plurality of said ignition branches are provided, said branches being connected to the medium voltage storage capacitor in parallel with respect to each other.

7. An ignition system according to claim 3, wherin a plurality of said ignition branches are provided, said branches being connected to the medium voltage storage capacitor in parallel with respect to each other.

* * * * *